United States Patent [19]

Gulliver

[11] 4,441,614

[45] Apr. 10, 1984

[54] FRONT LOADED AND CLOSED CARTON WITH HINGED TOP COVER

[75] Inventor: Richard F. Gulliver, Tuscaloosa, Ala.

[73] Assignee: Gulf States Paper Corporation, Tuscaloosa, Ala.

[21] Appl. No.: 459,146

[22] Filed: Jan. 19, 1983

[51] Int. Cl.[3] ..... B65D 5/54

[52] U.S. Cl. ..... 206/624; 206/45.31; 229/33

[58] Field of Search ..... 229/33, 36, 16 R, DIG. 9; 206/45.31, 624, 626

[56] References Cited

U.S. PATENT DOCUMENTS

| | | | |
|---|---|---|---|
| 1,080,643 | 12/1913 | Maguire | 229/33 |
| 1,724,636 | 8/1929 | Bell | 229/33 |
| 1,760,753 | 5/1930 | Hayden | 229/33 |
| 2,095,764 | 10/1937 | Rueckert | 229/33 |
| 2,316,701 | 4/1943 | Marshall | 229/33 |
| 2,373,701 | 4/1945 | Meredith | 229/DIG. 19 |
| 2,527,784 | 10/1950 | Acker | 229/16 R |
| 2,776,083 | 1/1957 | Derman | 206/45.31 |
| 3,189,245 | 6/1965 | Kistner | 229/16 A |
| 3,197,114 | 7/1965 | Holmes | 229/51 |
| 3,206,103 | 9/1965 | Bixler | 206/624 |
| 3,310,222 | 3/1967 | Buttery | 206/624 |
| 3,353,740 | 11/1967 | Outwater | 229/51 |
| 3,361,328 | 1/1968 | Buttery | 229/37 |
| 3,378,188 | 4/1968 | Meyers | 206/626 |
| 3,410,476 | 11/1968 | Buttery | 229/51 |
| 3,625,410 | 12/1971 | Hirschey | 229/16 R |
| 3,833,165 | 9/1974 | Hoiles | 229/37 R |
| 3,941,037 | 3/1976 | Reichert | 93/51 R |
| 4,180,165 | 12/1979 | Kuchenbecker | 206/45.31 |
| 4,240,576 | 12/1980 | Persson | 229/36 |

FOREIGN PATENT DOCUMENTS

| | | | |
|---|---|---|---|
| 946117 | 1/1964 | United Kingdom | 229/33 |

*Primary Examiner*—Stephen P. Garbe

[57] ABSTRACT

A carton partially erected from a cut and scored flat blank of paperboard for receiving a product horizontally therein so as to be fully erected into a closed product containing carton comprising a horizontal bottom panel of generally rectangular configuration, a front panel hinged to and extending horizontally forwardly from the forward edge of the bottom panel, a rear panel hinged to and extending vertically upwardly from the rear edge of the bottom panel, a cover panel hinged to and extending forwardly from the upper edge of the rear panel in parallel coextensive relation to the bottom panel, a closure panel hinged to and extending horizontally forwardly from the forward edge of the cover panel, a rear end flap hinged to each end of the rear panel and extending forwardly therefrom in generally perpendicular relation thereto, a bottom end flap hinged to each end of the bottom panel and extending vertically upwardly therefrom in abutting relation to the associated rear end flap, a cover end flap hinged to each end of the cover panel and extending vertically downwardly therefrom in abutting relation to the associated rear end flap and in overlapping relation to the associated bottom end flap, and adhesive means retaining the end flaps in abutting relation.

27 Claims, 7 Drawing Figures

FRONT LOADED AND CLOSED CARTON WITH HINGED TOP COVER

This invention relates to paperboard cartons and more particularly to paperboard cartons of the type erected from cut and scored flat blanks for use in containing bakery products and the like.

Existing bakery product cartons of the type herein contemplated are made from a flat blank which is cut and scored to provide a container structure and a closure structure. The container structure includes a rectangular bottom panel having a front panel hinged to one elongated side thereof and a rear panel hinged to the other elongated side thereof. The shorter ends of the bottom panel have end flaps hinged thereto. The rearward edge of each end flap has an end tab of generally triangular configuration hingedly connected therewith. In addition, each end flap has hinged to the forward edge thereof a tab which, in turn, is hinged to a similar tab hinged to the ends of the front panel. The rear panel also includes end flaps hinged to opposite ends thereof.

The closure structure includes a cover panel hinged to the side of the rear panel opposite the bottom panel hinge thereof and a closure panel hinged to the opposite side of the cover panel. The cover panel has its opposite ends hinged to a pair of end flaps and each end flap has hinged to the edge thereof adjacent the closure panel a glue tab.

In a normal commercial operation, machinery is utilized to partially erect successive flat blanks into a partially erect condition suitable to receive the product for loading therein. In the partially erect position, the end flaps hinged to the bottom panel are folded upwardly and the rearward tabs thereof are folded inwardly toward one another. The rear panel is hinged upwardly into engagement with the inwardly folded tabs and the rear panel end flaps are folded inwardly and connected with the upwardly folded bottom panel end flaps. The connection provided is one of the slit and tab type, the bottom end flaps being provided with suitable slits and the rear end flaps being provided with suitable slit entering tabs.

In addition to the partial erection of the bottom, rear and ends of the carton as aforesaid, the hingedly interconnected tabs of the bottom end flaps and front panel are folded inwardly in response to the upward folding of the front panel and then allowed to spring back. This leaves the partially erected carton in a condition wherein the ends are fully erected with the bottom and rear panels and the front panel is disposed in a partially closed position. The closure structure is completely retained in its flat condition and is disposed vertically above and within the same plane as the rear panel. In the partially erected condition the product to be contained within the carton is loaded vertically downwardly onto the bottom panel. The still unerected closure structure is then folded as a flat unit over the inserted product along the hinge line between the rear panel and the cover panel. The end flaps on the cover panel are then folded downwardly into abutting engagement with the previously erected bottom end flaps. The front panel is then moved upwardly into a fully erected position so as to enable the closure end flap glue tabs which are now disposed along the forward edge of the cover to be folded inwardly in a direction toward one another so as to be in a position to be engaged by the interior marginal edges of the closure panel when the latter is finally hinged downwardly along its connection with the cover panel. The container in its fully erected position is retained therein by a tear tab which is on the free edge of the closure panel and is glued to the adjacent exterior surface of the front panel when the latter is in its fully erected position.

In this fully erected product containing condition, the carton is shipped to the point of purchase by a product manufacturer. The fully erected carton, once purchased by a product consumer, is opened simply by removing the tear tab at the free edge of the closure panel. This permits the erected closure to be freely pivoted along the hinge line between the cover panel and rear panel into an open position. With the closure structure in an open position the receptacle structure is capable of expanding in volume by simply moving the front panel downwardly along its hinge with the bottom panel, the associated hinged tabs readily unfolding to permit such movement. While cartons of this type have proven to be acceptable particularly to the end user, there is always a need to improve the economics relating to the manufacture and use of the carton without detrimentally affecting the desirable functional characteristics thereof.

The object of the present invention is to fulfill the need described above. In accordance with the principles of the present invention this objective is achieved by reducing the size of the blank without reducing the size of the erected carton and in conjunction with the reduction in the size of the blank simplify the partial erection of the blank and the product loading facility thereof as well as the final erection and closing procedures. Reduction in the blank size is achieved primarily by a reduction in width of the blanks, although a reduction in length is likewise achieved. Simplicity in partial erection and loading is achieved by utilizing a simple plunger and die arrangement to accomplish partial erection into a condition for horizontal loading through the front, with closure being accomplished simply by manipulations performed from a position outwardly of the front face.

With respect to the width reduction, it will be noted that in the conventional flat blank the width must be of sufficient dimension to provide bottom end flaps which have a vertical extent when erected substantially equal to the vertical dimension of the interior of the container when fully erected. Likewise the end flaps of the cover are conveniently made of similar dimensions so as to fully cover the tab locks between the bottom end flaps and the rear end flaps when the carton is fully erected. With respect to the longitudinal dimension of the conventional flat blank, the closure panel is made to have a vertical extent when the carton is fully erected which is equal to the vertical extent of the closure end flaps.

In contrast to the above, the width of the flat blank of the present invention is substantially reduced because the ends of the erected carton are completed as a glued connection in the initial or partial erection of the flat blank. Conveniently this partial erection can be achieved simply by engaging the rear panel with a plunger which moves the flat blank through an erecting die cavity. Since the ends of the carton are glued in the initial partial erection of the carton, the bottom end flaps can be substantially diminished in dimension from the full height dimension required in the conventional carton blank. Desirably, the dimension when erected is slightly greater than one-half the vertical interior dimension of the fully erected carton. The upper portion of the ends of the container are formed by the closure end flaps and these have a generally equal vertical extent to the bottom end flaps so that there is an overlap when in the erected condition, with the over-lapping end flaps being glued to the end flaps of the rear panel which are folded inwardly.

It can thus be seen that the initial erected condition of the carton provides loading access through the part of the carton which defines the front when completed. The partially erected carton is oriented so that the access opening is presented horizontally so that the loading takes place horizontally. This is particularly desirable in loading products such as cakes or the like which cannot be easily and safely loaded by vertical movement. With respect to the reduction in the longitudinal dimension of the flat blank, it will be noted that the vertical extent of the closure panel when in its fully erected position is chosen as to be generally equal to the reduced vertical dimension of the closure end flap. The final erection or closure of the partially erected flat blank is conveniently accomplished at a position outwardly of the open front face and consists in folding in the bottom end flap tabs and then folding up the bottom panel. Next, the glue tabs on the closure end flaps are hinged inwardly, so as to receive the closure panel which is hinged down to complete the closure.

These and other objects of the present invention will become more apparent during the course of the following detailed description and appended claims.

The invention may best be understood with reference to the accompanying drawings, wherein an illustrative embodiment is shown.

Figure 1:
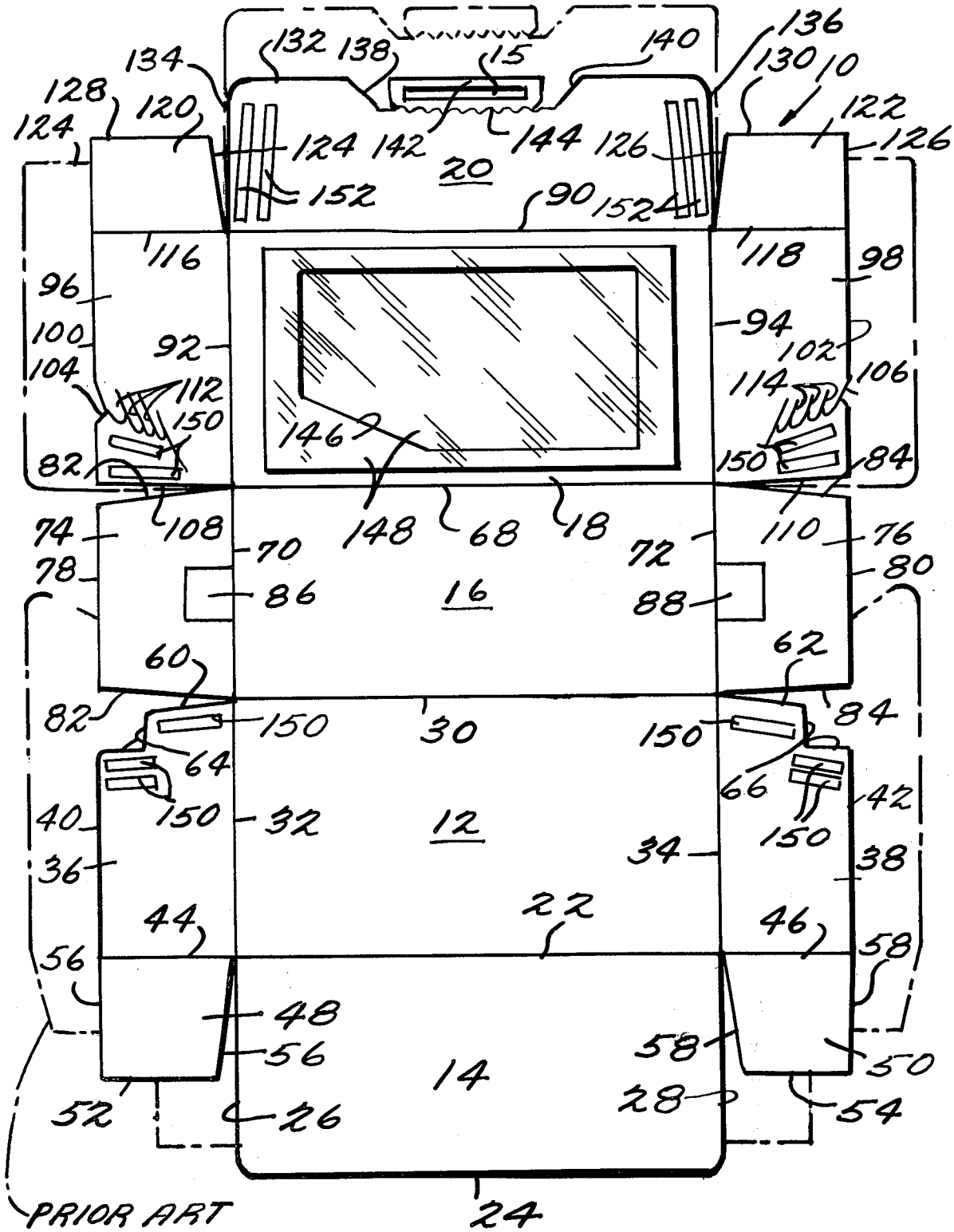
FIG. 1 is a top plan view of a cut and scored flat blank embodying the principles of the present invention showing the same superimposed over a known prior art cut and scored flat blank of the same erected carton size, the prior art blank being shown in phantom lines.

Referring now more particularly to the drawings, there is shown in FIG. 1 thereof a cut and scored flat blank of paperboard material, generally indicated at 10, which embodies the principles of the present invention. The flat blank 10 is constructed so as to be erected into a carton of the type utilized to contain bakery products and the like. The flat blank 10 is shown in FIG. 1 in full lines superimposed over a known prior art cut and scored flat blank, shown in phantom lines, which is erectable into a carton of the same size as that of the present invention for containing the same product. It will be noted that the flat blank 10 of the present invention is considerably narrower than the conventional blank and its longitudinal dimension is less as well. This saving in the material of the flat blank is a highly desirable advantageous feature of the present invention. A second highly advantageous feature of the present invention is the simplicity with which it is partially erected for loading, the partially erected construction providing the advantage of horizontal loading through one face and final closure through manipulation of portions of the flat blank which are exteriorly forward of the open face and capable of closure from such exterior position.

As shown in FIG. 1, the flat blank includes the usual hingedly interconnected bottom panel 12, front panel 14, rear panel 16, cover panel 18 and closure panel 20, all of which are of rectangular configuration. In accordance with the principles of the present invention, the rectangular configuration of the front panel 14 is defined along one side by hinge fold line 22 which is common with the bottom panel 12, the remainder of the periphery of the front panel 14 being defined by cut free edges including a side edge 24 parallel to the hinge line 22 and parallel end edges 26 and 28.

The rectangular configuration of the bottom panel 14 in addition to the fold line 22 common with the front panel 14 is defined along its opposite side by a fold line 30 common with the rear panel 16 and along its ends by fold lines 32 and 34 which, in turn, are common with end flaps 36 and 38 respectively. The outer ends of end flaps 36 and 38 are defined by cut free edges 40 and 42 respectively, which are disposed parallel with the associated fold lines 32 and 34 respectively. The relationship between the perpendicular distance between the fold lines 32 and 34 and the associated free edges 40 and 42 and the perpendicular distance between the fold line 22 of the front panel 14 and the free side edge 24 thereof is of importance in enabling the flat blank 10 of the present invention to have the aforesaid size reduction in width. Specifically, the distance between the bottom panel fold line and free end edge of each bottom end flap measured perpendicularly is substantially less than the perpendicular distance between the side fold line 22 of the front panel 14 and the free side edge 24 thereof but more than one-half the distance thereof.

The front sides of the bottom end flaps 36 and 38 are defined by fold lines 44 and 46 respectively, which are disposed in general alignment with the fold line 22 and are common with an end tab 48 and 50, respectively. The end tabs 48 and 50 are of generally rectangular configuration and are defined along their front sides by free edges 52 and 54 respectively which are spaced from the associated fold lines 44 and 46 a distance less than the distance between the fold line 22 and free side edge 24 of front panel 14. The end tabs 48 and 50 are defined along their ends by generally parallel cut free end edges 56 and 58 respectively. The rear sides of the bottom end flaps 36 and 38 are defined by cut inclined free edges 60 and 62 respectively which extend outwardly and forwardly from the adjacent end of the fold line 30 to cut-out corner notches 64 and 66 respectively, each defined by two angularly related free edges.

Rear panel 16, which has a peripheral configuration corresponding with that of the front panel 14, is defined along its front side by the fold line 30 common with the bottom panel 12 and along its rear side with a fold line 68 which is common with the cover panel 18. The ends of the rear panel 16 are defined by fold lines 70 and 72 which are common with integral end flaps 74 and 76. The outer ends of the end flaps 74 are defined by cut free end edges 78 and 80 respectively which are generally aligned with the free end edges 40 and 42 respectively of the bottom end flaps 36 and 38. The sides of the rear end flaps 74 and 76 are defined by outwardly converging cut free side edges 82 and 84 respectively.

Formed within the central portions of the rear end flaps 78 and 80 are embossed rectangular portions 86 and 88 respectively. The embossed portions 86 and 88 are disposed inwardly within the associated end flaps 78 and 80 adjacent the associated fold lines 70 and 72. The rectangular size of the embossed portions 86 and 88 corresponds with the size of the associated corner notches 64 and 66 and the spacing of the embossed portions 86 and 88 from the associated ends of the fold lines 30 is generally equal to the extent of the associated rear edge portions 60 and 62 of the associated bottom end flaps 36 measured perpendicularly from the associated fold lines 32 and 34.

Cover panel 18 is of a rectangular size slightly greater than the rectangular size of the bottom panel 12. It is defined along its forward side by the fold line 68 common with the rear panel 16 and along its rearward side by a fold line 90 common with the closure panel 20. The ends of the cover panel 18 are defined by fold lines 92 and 94 which are common with integral end flaps 96 and 98 respectively. The cover end flaps 96 and 98 are defined along their outer ends by cut free end edges 100 and 102 respectively generally parallel with the associated fold lines 92 and 94. The free edges 100 and 102 have notches 104 and 106 respectively cut therein each defined by two angularly related free edges. The forward sides of the cover end flaps 96 and 98 are defined by cut perpendicular free edges 108 and 110 respectively. Formed within the cover end flaps 96 and 98 are parallel cuts 112 and 114 respectively which extend generally diagonally from the notches 104 and 106 to the associated front end edges 108 and 110 respectively. The rear ends of the cover end flaps are defined by fold lines 116 and 118 which are common respectively with end tabs 120 and 122 respectively. The ends of the tabs 120 and 122 are defined by cut parallel free edges 124 and 126 respectively. The rear sides of the tabs 120 and 122 are defined by cut free side edges 128 and 130 respectively which are disposed generally parallel to the associated fold lines 116 and 118. It is noted that the outer end edges 124 and 126 of the end tabs are aligned with the associated end edges 100 and 102 of the associated end flaps 96 and 98.

Closure panel 20 is of generally rectangular configuration and is defined along its forward side by the fold line 90 which is common to the cover panel 18. The rearward side of the closure panel 20 is defined by a cut parallel free side edge 132. The ends of the closure panel 20 are defined by cut inclined free end edges 134 and 136. It will be noted that the perpendicular dimension between the free side edge 132 of the closure panel 20 and the fold line 90 thereof is substantially less than the perpendicular dimension between the fold line 22 and side edge 24 of the front panel 14 but greater than one-half the distance thereof. In general, the aforesaid perpendicular dimension of the closure panel 20 is generally the same as the perpendicular distance between the outer end edges 40 and 42 of the end flaps 36 and 38 respectively and the associated fold lines 32 and 34 respectively thereof. It will be noted that the central portion of the free edge 132 of the closure panel 20 includes spaced diagonal cut-outs 138 and 140 which define therebetween a glue tab 142. Glue tab 142 is made easily removable by a series of interrupted cuts 144 extending between the diagonal cuts 138 and 140 respectively.

Finally it will be noted that cover panel 18 includes a cut-out central portion 146 which is covered interiorly by a panel of cellophane or other transparent film 148. It will be understood that the clear plastic panel 148 forms a part of the cover panel and that the cut-out and cover film can be extended into the rear panel if desired.

In accordance with the principles of the present invention, the flat blank 10 is initially formed into a partially erected condition for loading by the utilization of a suitable erecting apparatus (not shown) which includes a stationary die cavity and a plunger. The plunger has a bottom surface which is rectangular and corresponds in size to the rear panel 16. In utilizing the partial erecting apparatus the blank 10 is placed over the die cavity in a position to be engaged by the plunger from above moving downwardly. Prior to the downward movement of the plunger daubs of hot melt adhesive 150 are applied to the portions of the bottom end flaps 36 and 38 defining the notches 64 and 66 respectively and the triangular corner portions of the cover end flaps 96 and 98 defined by the notches 104 and 106 and parallel cuts 112 and 114 respectively. It will be understood that other types of adhesive means may be utilized as, for example, heat fusion of coatings or a heat activatated adhesive may be applied to these blank areas prior to partial erection.

Figure 2:
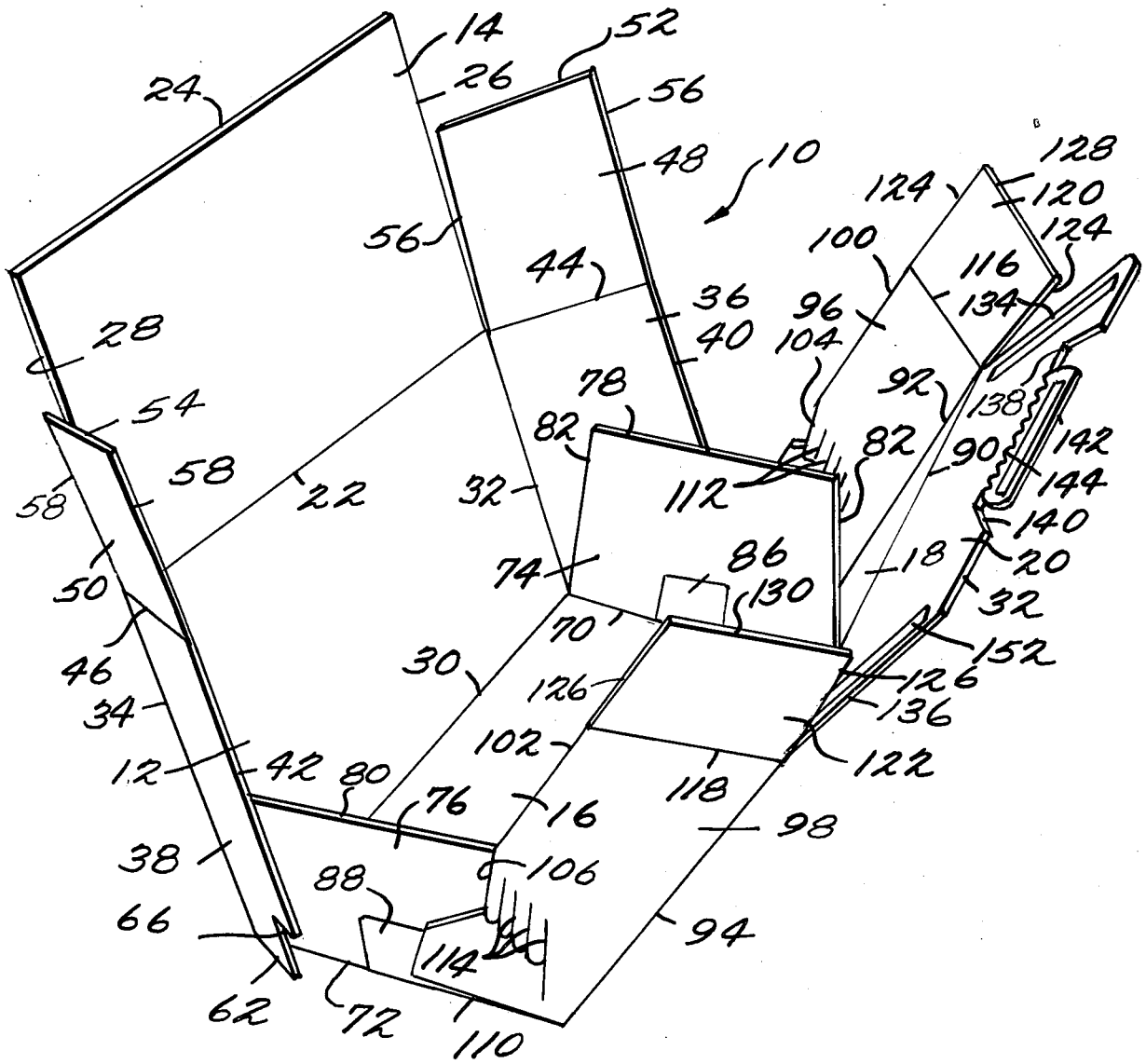
FIG. 2 is a perspective view of the flat blank shown in solid lines in FIG. 1 disposed in a position assumed during the initial erection of the blank into a partial product receiving condition.
Figure 5:
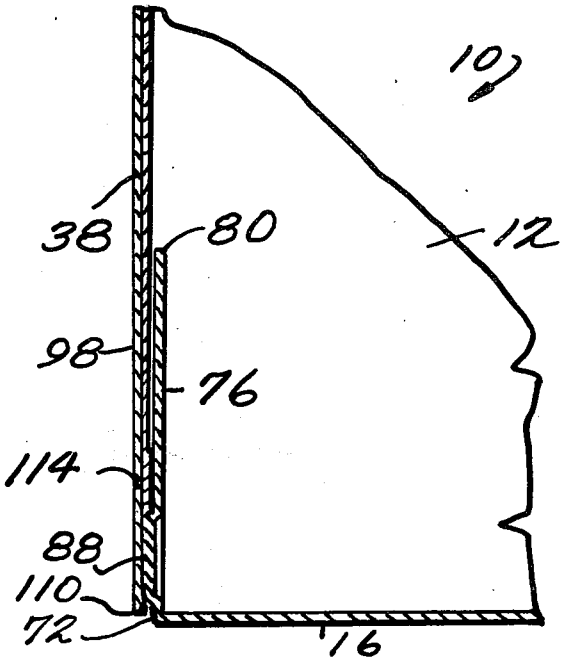
FIG. 5 is an enlarged fragmentary sectional view taken along the line 5—5 of FIG. 3.

After the blank has been positioned over the die cavity with the glue spots or daubs applied thereto, on the downward operative stroke of the plunger the lower surface of the latter engages the rear panel 16. As the flat blank is moved downwardly into the die cavity by the plunger, the rear panel end flaps 74 and 76 are first hinged upwardly about the fold lines 70 and 72 respectively. The bottom panel 12 and front panel 14 are then hinged upwardly as a unit about the fold line 30. Next the cover panel 18 and closure panel 20 are hinged upwardly as a unit along the fold line 68. During the upward hinging movement of the bottom and front panels, bottom end flaps 36 and 38 together with tabs 48 and 50 are hinged inwardly about the fold lines 32 and 34 respectively so that their inner surfaces come into abutting engagement with the outer surfaces of the upwardly hinged rear end flaps 74 and 76 respectively. Similarly, during the upward hinging movement of the cover and closure panels 18 and 20, cover end flaps 96 and 98, together with tabs 120 and 122, are hinged inwardly about the fold lines 92 and 94 respectively so that the inner surfaces thereof will move into abutting engagement with the outer surfaces of the embossed portions 86 and 88 of the rear end flaps 74 and 76 respectively and the adjacent outer surface areas of the overlapping bottom end flaps 36 and 38 respectively. FIG. 2 illustrates the partially erected position of the flat blank 10 showing the movement of the end flaps into abutting engagement as aforesaid.

Figure 3:
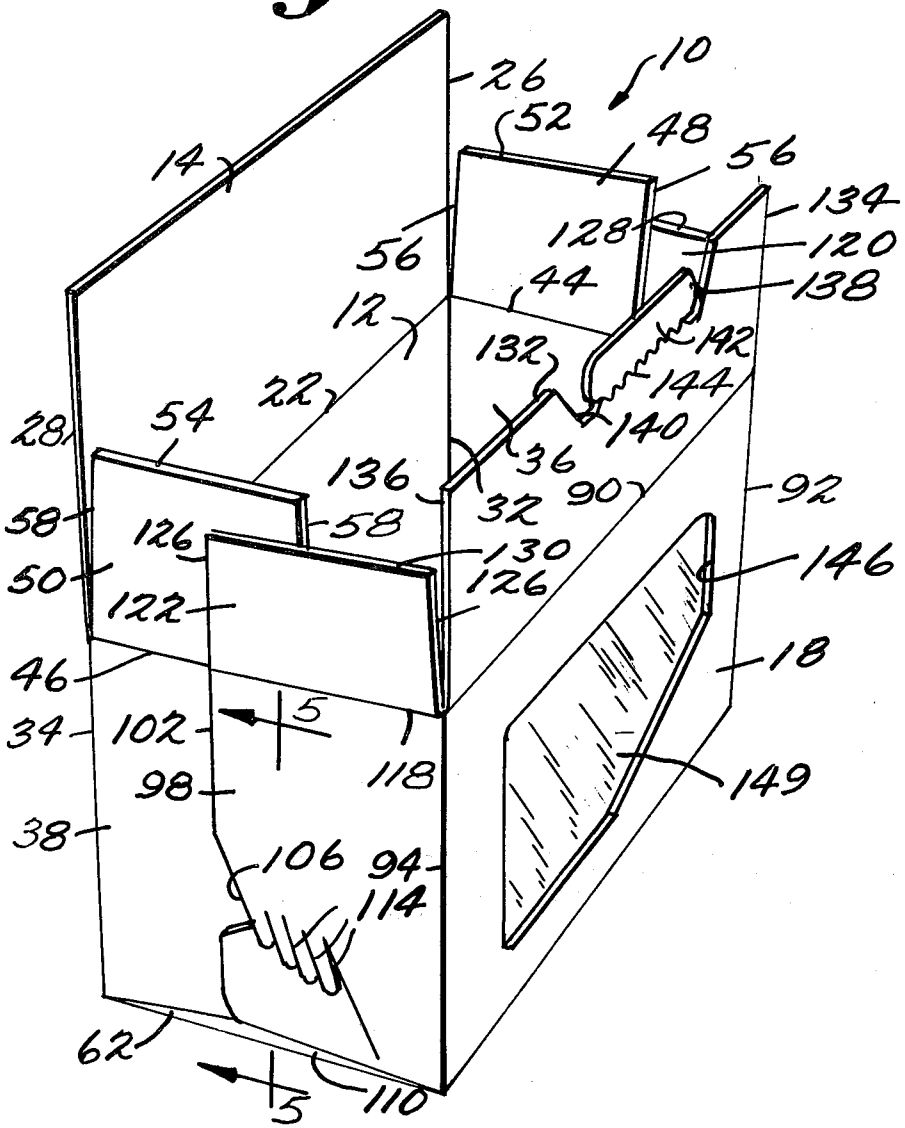
FIG. 3 is a perspective view of the blank shown in FIG. 2 after it has been initially erected into its partial product receiving condition.

After the plunger has been moved completely through the die cavity, the flat blank is glued into its partially erected position and is then stripped from the plunger and oriented for product loading so that the rear wall extends vertically rather than horizontally. The product receiving condition of the partially erected blank or carton 10 is shown in FIG. 3. It will be noted that the front of the partially erected carton is open for horizontal loading of the product into the partially erected carton and that all of the panels and tabs required to effect closure of the carton into a fully erected condition are disposed outwardly of the front so as to be capable of manipulation from one position outwardly of the front.

Prior to the performance of the final closure steps, daubs or spots of hot melt adhesive 152 are applied to the closure panel 20 along marginal portions defined by the inclined free end edges 134 and 136 and along the removable glue tab 142. Here again, the adhesive means may be a heat activated adhesive applied to the blank while in the flat condition. Where a hot melt adhesive 152 is used it may be applied just prior to the performance of the final closure steps or at the same time that the hot melt adhesive 150 is applied where the apparatus for effecting partial erection is embodied as part of a total apparatus which also serves to load the partially erected carton with product and preferably also to effect final closure.

Figure 4:
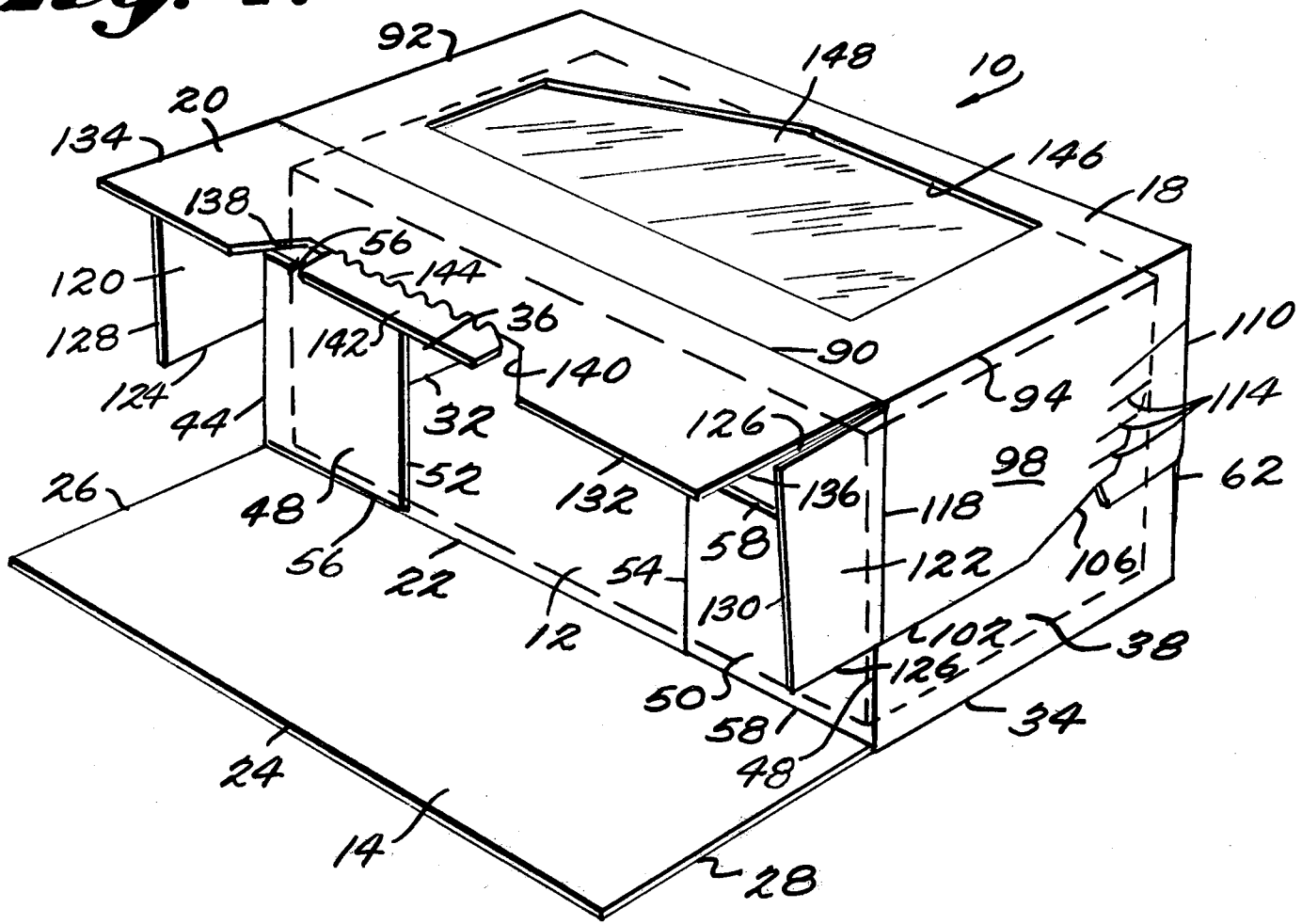
FIG. 4 is a perspective view of the initially erected blank after the product has been horizontally loaded therein and the first step in the final erection of the blank has been completed.

FIG. 4 illustrates the condition of the partially erected carton after loading and after the first step in the final closure of the partially erected carton has been accomplished. In this regard it will be noted that the forwardly extending bottom end flap tabs 48 and 50 have been hinged inwardly along fold lines 44 and 46 respectively so that their outer surfaces are in the plane of the open front. Next, front panel 14 is hinged upwardly along fold line 22 and then the forwardly extending cover end flap tabs 120 and 122 are hinged inwardly along fold lines 116 and 118. The final step in effecting the closure of the carton is to hinge closure panel downwardly along fold line 90 insuring that the adhesive spots 152 on the under surface thereof function to secure the closure panel both to the tabs 120 and 122 and the front panel 14.

Figure 6:
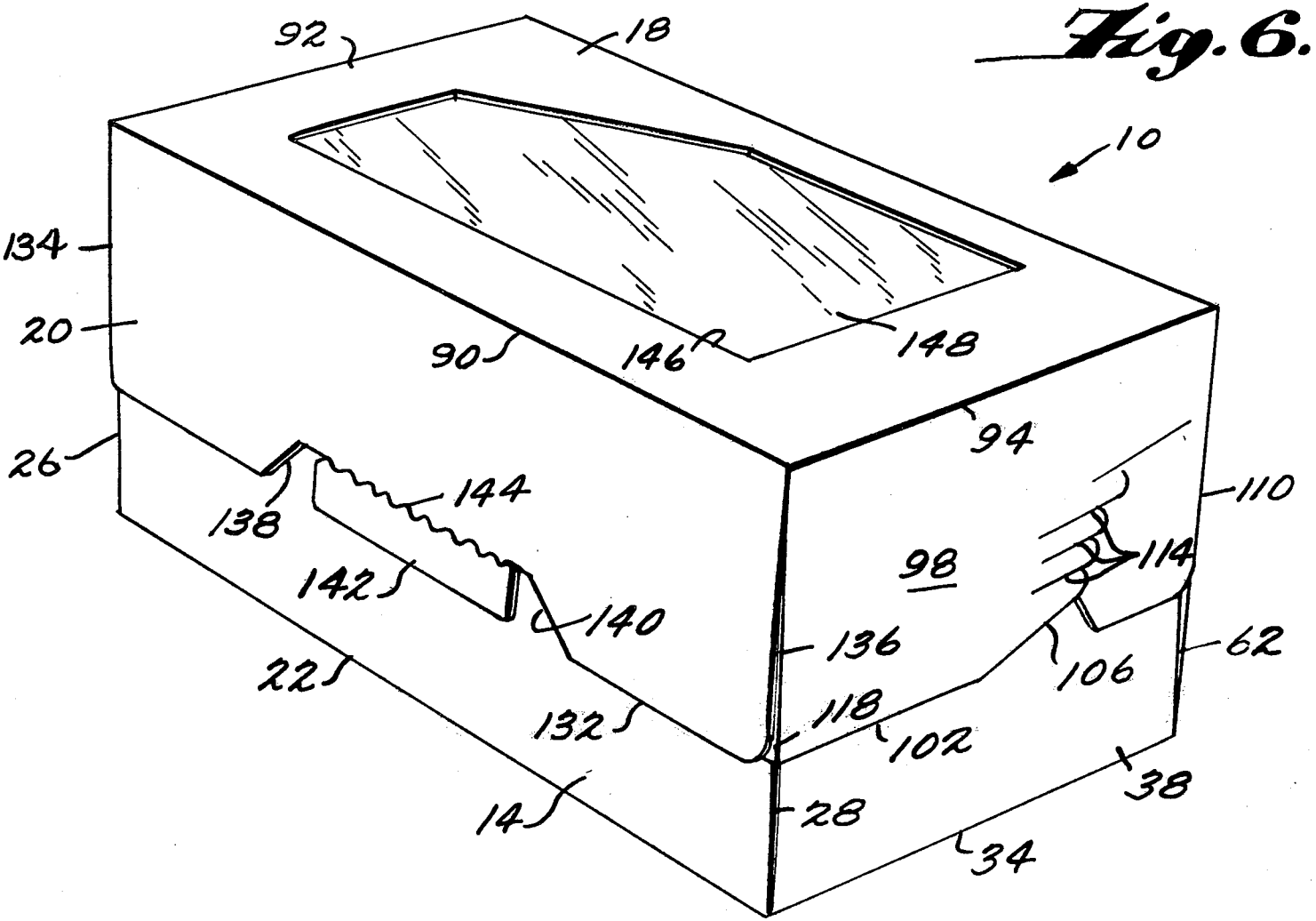
FIG. 6 is a perspective view of the fully erected product containing carton made from the flat blank shown in FIG. 1.

FIG. 6 illustrates the fully erected product containing carton in the condition in which it would be shipped from the bakery to the retail outlet for sale. The user prepares the fully closed carton for opening by removing the glue tab 142 or by otherwise separating the closure panel from the front panel by completing the severance of the glue tab 142 from the remainder of the closure panel along the interrupted cuts 144. Once the closure panel 20 has been separated from the front panel 14, the adhesive securement of the closure panel with tabs 120 and 122 insures that the closure panel 20, cover panel 18 and end flaps 96 and 98 thereof constitute a rigid three-dimensional cover structure which is retained in closed position by virtue of the adherence of the corner portions of the end flaps 96 and 98 with the embossed portions 86 and 88 respectively by means of adhesive 150. When the user lifts this rigid cover structure the weakened integrity of the paperboard provided by the notches 104 and 106 and parallel cuts 112 and 114 facilitate the separation of the glued corner portion of the end flaps 96 and 98 from the remainder and hence a lifting pressure on the cover structure results in the severance of the cover end flaps 96 and 98 from the glued corner portions thereof and the upward hinging of the cover structure along the fold line 68 common with the upper edge of the rear panel 16.

Figure 7:
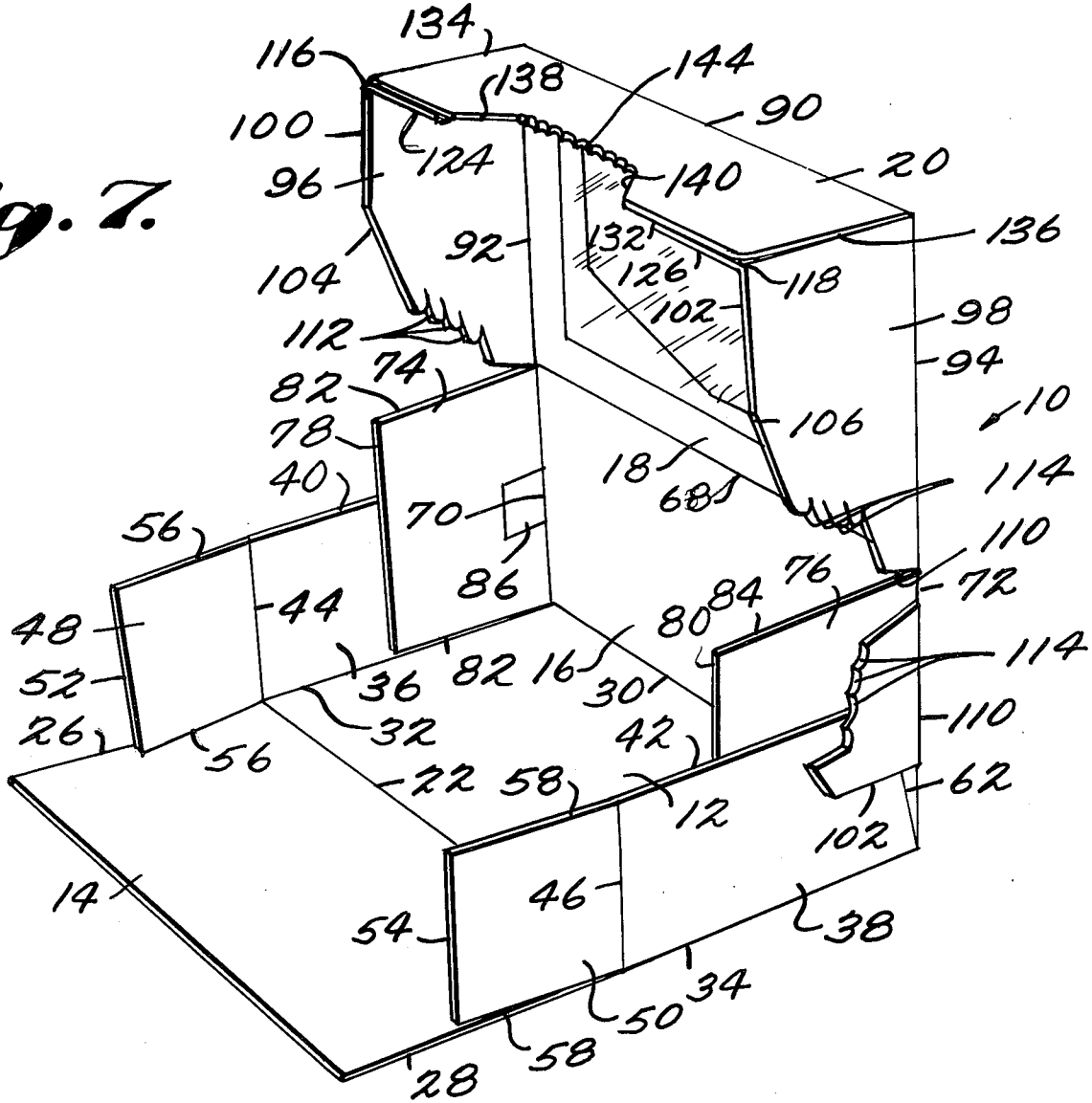
FIG. 7 is a perspective view showing the condition of the fully erected carton after opening by the product consumer.

FIG. 7 illustrates the carton with the cover structure in its opened position and it will be noted that the front panel 14 is free to hinge downwardly along the fold line 22 and tabs 48 and 50 are free to hinge outwardly along fold lines 44 and 46 respectively. This provides full access to the product by the user. It will be understood that while it is preferred to provide a freely hinging front panel, it is within the contemplation of the present invention to utilize fold-in tabs along and between the front panel and the bottom end flaps if desired. It will also be noted that in the event it is desired to re-close the carton after it has been opened as indicated in FIG. 7, it is necessary merely to hinge the front panel 14 upwardly along the fold line 24 with tabs 48 and 50 hinged inwardly and to lower or hinge the cover structure downwardly about the fold line 68.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A cut and scored flat blank of paperboard for erection into a product containing carton comprising a rectangular bottom panel, a rectangular front panel hinged along one side to one side of said bottom panel in coextensive relation therewith, the opposite side and ends of said rectangular front panel being defined by cut free edges, a rectangular rear panel hinged along one side to the opposite side of said bottom panel, said rectangular rear panel being of a size substantially equal to the size of said front panel, a rectangular cover panel hinged along one side to the opposite side of said rear panel, said rectangular cover panel being of a size substantially equal to the size of said bottom panel, and a rectangular closure panel hinged along one side to the opposite side of said cover panel in coextensive relation therewith, said bottom, rear and cover panels having end flaps hinged to the ends thereof, the dimension of each of said end flaps measured perpendicular to its associated panel hinge being substantially less than the dimension of said rear panel measured perpendicularly between the hinged sides thereof, the aforesaid dimension of each bottom end flap and each closure end flap being greater than one-half the aforesaid dimension of said rear panel.

2. A flat blank as defined in claim 1 wherein the dimension of said closure panel measured perpendicularly between the hinged side thereof and the opposite side thereof is generally equal to the aforesaid dimension of each of said bottom and closure end flaps.

3. A flat blank as defined in claim 2 wherein each of said rear end flaps is provided with an embossed portion adjacent its hinge and each of said bottom end flaps has a notch formed therein of a size and shape to receive therein the embossed portion of the associated rear end flap when said flat blank is erected.

4. A flat blank as defined in claim 3 wherein each cover end flap is formed with a notch in the outer free end thereof and a plurality of parallel cuts extending from said notch so as to define a generally triangularly shaped free corner portion thereof.

5. A flat blank as defined in claim 1 wherein each of said rear end flaps is provided with an embossed portion adjacent its hinge and each of said bottom end flaps has a notch formed therein of a size and shape to receive therein the embossed portion of the associated rear end flap when said flat blank is erected.

6. A flat blank as defined in claim 1 wherein each cover end flap is formed with a notch in the outer free end thereof and a plurality of parallel cuts extending from said notch so as to define a generally triangularly shaped free corner portion thereof.

7. A flat blank as defined in claim 1 wherein the periphery of the closure panel is defined along one side by the hinge with said cover panel, along its opposite side by a cut free side edge and along opposite ends by cut free end edges.

8. A carton partially erected from a cut and scored flat blank of paperboard for receiving a product horizontally therein so as to be fully erected into a closed product containing carton comprising a horizontal bottom panel of generally rectangular configuration, a front panel hinged to and extending horizontally forwardly from the forward edge of said bottom panel, a rear panel hinged to and extending vertically upwardly from the rear edge of said bottom panel, a cover panel hinged to and extending forwardly from the upper edge of said rear panel in parallel coextensive relation to said bottom panel, a closure panel hinged to and extending horizontally forwardly from the forward edge of said cover panel, a rear end flap hinged to each end of said rear panel and extending forwardly therefrom in generally perpendicular relation thereto, a bottom end flap hinged to each end of said bottom panel and extending vertically upwardly therefrom in abutting relation to the associated rear end flap, a cover end flap hinged to each end of said cover panel and extending vertically downwardly therefrom in abutting relation to the associated rear end flap and in overlapping relation to the associated bottom end flap, and adhesive means for retaining said end flaps in said abutting relation.

9. A partially erected carton as defined in claim 8 wherein each of said cover end flaps has a tab hinged to the forward edge thereof and extending horizontally forwardly therefrom.

10. A partially erected carton as defined in claim 9 wherein each bottom end flap has a tab hinged to the forward edge thereof and extending horizontally forwardly therefrom.

11. A partially erected carton as defined in claim 10 wherein the dimension of each of said end flaps measured perpendicular to its associated panel hinge is substantially less than the dimension of said rear panel measured perpendicularly between the panel hinges thereof, the aforesaid dimension of each bottom end flap and each closure end flap being greater than one-half the aforesaid dimension of said rear panel.

12. A partially erected carton as defined in claim 11 wherein the dimension of said closure panel measured perpendicular to the panel hinge thereof is generally equal to the aforesaid dimension of each of said bottom and closure end flaps.

13. A carton as defined in claim 8 wherein said front panel is defined peripherally along its bottom side by the hinge with said bottom panel, along its top side by a cut free edge and along its ends by cut free edges.

14. A partially erected carton as defined in claim 8 wherein each of said rear end flaps is provided with an embossed portion adjacent its hinge to said rear panel and each of said bottom end flaps has a notch formed therein of a size and shape to receive therein the embossed portion of the associated rear end flap when in the aforesaid abutting relation therewith.

15. A carton as defined in claim 14 wherein a generally triangularly shaped corner portion of each cover end flap is disposed in abutting relation with the associated embossed portion of the associated rear end flap and the adjacent portion of the associated bottom end flap defining the associated notch.

16. A carton as defined in claim 15 wherein each cover end flap is formed with a notch in the lower edge thereof and a plurality of parallel cuts extending upwardly and rearwardly from said notch so as to define the aforesaid triangular corner portion thereof.

17. A carton as defined in claim 16 wherein glued tab means is provided between said cover end flaps and said closure panel for retaining said closure panel in a closed perpendicular relation with said cover end flaps and said cover panel so as to permit the same to act as a unitary cover structure swingable about the hinge between said cover and rear panels from a closed position wherein said cover panel, cover end flaps and the closure panel are disposed in the position aforesaid into an open position providing access to a receptacle structure defined by the front panel, bottom panel, rear panel and associated end flaps and releasable means for releasably retaining said cover structure in its closed position.

18. A carton as defined in claim 17 wherein the triangular corner portion of each cover end flap constitutes the only portion of said cover end flaps where said adhesive means in the form of an adhesive is applied to said cover end flaps so that when the cover structure is moved into its open position the triangular corner portions of said cover end flaps are separated along the notches and parallel cuts defining the same from the remainder of the cover structure and retained by said adhesive means in abutting relation to the associated embossed portion of the associated rear end flap and the notch defining portion of the associated bottom end flap.

19. A carton as defined in claim 17 wherein said releasable means comprises a glue tab formed in the lower marginal side portion of said closure panel, said closure panel having notches and spaced cuts releasably defining said glue tab, said glue tab being adhesively adhered to said front panel.

20. A partially erected carton as defined in claim 8 wherein said closure panel is defined peripherally along its rearward side by the hinge with said cover panel, along its forward side by a cut free edge and along its ends by cut free edges.

21. A carton erected from a cut and scored flat blank of paperboard comprising a horizontal bottom panel of generally rectangular configuration, a front panel hinged to and extending vertically upwardly from the forward edge of said bottom panel in coextensive relation therewith, said front panel being defined peripherally along its bottom side by the hinge with said bottom panel, along its top side by a cut free edge and along its ends by cut free edges, a rear panel hinged to and extending vertically upwardly from the rear edge of said bottom panel in parallel coextensive relation with said front panel, a cover panel hinged to and extending forwardly from the upper edge of said rear panel in parallel coextensive relation to said bottom panel, a closure panel hinged to and extending vertically downwardly from the forward edge of said cover panel in overlapping abutting relation with said front panel, a rear end flap hinged to each end of said rear panel and extending forwardly therefrom in generally perpendicular relation thereto, a bottom end flap hinged to each end of said bottom panel and extending vertically upwardly therefrom in abutting relation to the associated rear end flap to a height substantially less than the height of said front panel but greater than one-half the height thereof, a cover end flap hinged to each end of said cover panel and extending vertically downwardly therefrom to a vertical extent generally equal to the vertical extent of the associated bottom end flap in abutting relation to the associated rear end flap and in over-lapping relation to the associated bottom end flap, adhesive means for retaining said end flaps in said abutting relation, glued tab means between said cover end flaps and said closure panel for retaining said closure panel in perpendicular relation with said cover end flaps and said cover panel so as to permit the same to act as a unitary cover structure swingable about the hinge between said cover and rear panels from a closed position wherein said cover panel, cover end flaps and the closure panel are disposed in the position aforesaid into an open position providing access to a receptacle structure defined by the front panel, bottom panel, rear panel and associated end flaps, and releasable means for releasably retaining said cover structure in its closed position.

22. A carton as defined in claim 21 wherein each of said rear end flaps is provided with an embossed portion adjacent its hinge to said rear panel and each of said bottom end flaps has a notch formed therein of a size and shape to receive therein the embossed portion of the associated rear end flap when in the aforesaid abutting relation therewith.

23. A carton as defined in claim 22 wherein a generally triangularly shaped corner portion of each cover end flap is disposed in abutting relation with the associated embossed portion of the associated rear end flap and the adjacent portion of the associated bottom end flap defining the associated notch.

24. A carton as defined in claim 23 wherein each cover end flap is formed with a notch in the lower edge thereof and a plurality of parallel cuts extending upwardly and rearwardly from said notch so as to define the aforesaid triangular corner portion thereof.

25. A carton as defined in claim 24 wherein the triangular corner portion of each cover end flap constitutes the only portion of said cover end flaps where said end flap adhesive means in the form of an adhesive is applied to said cover end flaps so that when the cover structure is moved into its open position the triangular corner portions of said cover end flaps are separated along the notches and parallel cuts defining the same from the remainder of the cover structure and retained by said adhesive means in abutting relation to the associated embossed portion of the associated rear end flap and the notch defining portion of the associated bottom end flap.

26. A carton as defined in claim 25 wherein the height of said closure panel is generally equal to the height of said cover end flaps.

27. A carton as defined in claim 21 wherein said closure panel is defined peripherally along its rearward side by the hinge with said cover panel, along its forward side by a cut free edge and along its ends by cut free edges.

* * * * *